United States Patent [19]

Nakasugi et al.

[11] 4,138,278

[45] Feb. 6, 1979

[54] METHOD FOR PRODUCING A STEEL SHEET HAVING REMARKABLY EXCELLENT TOUGHNESS AT LOW TEMPERATURES

[75] Inventors: Hajime Nakasugi; Hiroaki Masui; Hiroshi Tamehiro; Hiroo Mazuda, all of Kimitsu, Japan

[73] Assignee: Nippon Steel Corporation, Tokyo, Japan

[21] Appl. No.: 826,820

[22] Filed: Aug. 22, 1977

[30] Foreign Application Priority Data

Aug. 27, 1976 [JP] Japan ..... 51-102239
Apr. 28, 1977 [JP] Japan ..... 52-48497

[51] Int. Cl.[2] ..... C21D 7/14
[52] U.S. Cl. ..... 148/12 R; 148/12 F
[58] Field of Search ..... 148/12 R, 12 F

[56] References Cited

U.S. PATENT DOCUMENTS

| | | | |
|---|---|---|---|
| Re. 28,645 | 12/1975 | Aoki et al. | 148/12 F |
| 3,960,612 | 6/1976 | Kaku et al. | 148/12 F |
| 3,997,372 | 12/1976 | Matas et al. | 148/12 F |

*Primary Examiner*—W. Stallard
*Attorney, Agent, or Firm*—Wenderoth, Lind & Ponack

[57] ABSTRACT

A method for producing a steel sheet having excellent low-temperature toughness, comprising a step of heating to a temperature not higher than 1150° C., a steel slab containing 0.01 - 0.13% C, 0.05 - 0.8% Si, 0.8 - 1.8% Mn, 0.01 - 0.08% total Al, 0.08 - 0.40% Mo and not more than 0.015% S with the balance being iron and unavoidable impurities, and a step of hot rolling the steel slab thus obtained by at least three passes with a minimum reduction percentage not less than 2% by each rolling pass in a temperature range of 900 - 1050° C., a total reduction percentage not less than 50%, and with a finishing temperature not higher than 820° C.

16 Claims, 8 Drawing Figures

METHOD FOR PRODUCING A STEEL SHEET HAVING REMARKABLY EXCELLENT TOUGHNESS AT LOW TEMPERATURES

FIELD OF THE INVENTION

The present invention relates to a method for producing a steel sheet for pipe lines and fittings having excellent DWTT (Drop Weight Tear Test) characteristics at low temperatures at −30° C. or lower as specified by API SR6.

BACKGROUND OF THE INVENTION

In recent years greater importance has been placed on the natural gas as a new energy source and prospecting and developing works have been underway in the Arctic region to seek new gas fields. Along these prospecting and developing works, demands for high-tensile high toughness large-diameter gas line pipes and fittings which can realize efficient and economical transportation of the gas to consuming cities have been increasing rapidly.

Steel pipes for use in gas pipe lines are required to have an excellent ductility as determined by DWTT which represents the property of preventing brittle fracture as well as an excellent charpy impact value in order to prevent a large scale ductile fracture of the pipe lines and the fittings.

Conventionally, steel sheets for the gas line pipes which satisfy the above severe material properties have been produced by the so-called "controlled rolling method" (hereinafter called "CR"), and Nb-containing steels (hereinafter called "Nb-steels") have been mainly used for the purpose.

The Nb-steel is one of the most commonly used steel grades and has very excellent properties, but on the other hand the steel has lack of the following characteristics:

(1) In order to utilize Nb effectively for precipitation hardening and refinement of grains, it is necessary to dissolve coarse precipitation of Nb (CN) contained in the steel slab fully into solid solution during the heating of the slab.

However, precipitated Nb (CN) is stable at high temperatures so that it is not fully dissolved into solid solution at 1150° C. or lower, and it is necessary to maintain a considerably long period of holding time for the heating, thus causing lowering in the productivity of the heating furnace.

(2) When the steel slab is heated in a temperature up to 1150° C. where Nb(CN) begins to dissolve into solid solution, the amount of Nb in solid solution thus obtained varies considerably due to fluctuations of the heating temperature. When the amount of Nb in solid solution increases excessively, the austenite grains (heated $\gamma$ grains) formed during the heating are in a remarkably mixed grain so that the toughness deteriorates, and even when the rolling is done under the same condition as in case of the steel slab in which the austenite grains are not in a mixed grain, the strength increases excessively so that the material quality lacks in stability.

(3) Nb is an element which strongly prevents recrystallization of the rolled austenite grains (rolled $\gamma$ grains) during the rolling so that below about 1050° C. no satisfactory recrystallization proceeds. Therefore, non-recrystallization (elongated austenite grain) of the austenite grains takes place before the grains are converted into fine recrystallized rolled austenite grains during the rolling, so that such difficulties are confronted as that the reduction amount is not enough in the non-recrystallization temperature zone, and that when the rolling is finished at a high temperature range in the non-recrystallization zone, the rolled structure thus obtained is a coarse mixed grain structure and susceptible to occurrence of the Widmanstatten structure particularly in case when a final plate thickness is thick.

(4) When the warm rolling is strengthened, the yield ratio $$\left(YR = \frac{\text{yield strength(YS)}}{\text{tensile strength(TS)}}\right)$$

reaches as high as 95% so that the production of the steel pipe, such as UO process becomes difficult to form to pipe, and deterioration of the yield strength due to the Bauschinger effect is considerable and thus excessive yield strength is required for the steel sheet.

(5) During the welding of the steel sheet, precipitated Nb(CN) is apt to resolidify and the hardness increases remarkably, and toughness of the weld metal and the welding heat-affected zone (herein called "HAZ") deteriorates considerably. Also when the stress-relieve annealing (SR) is performed, the Nb which resolidifies during the welding precipitates to lower the toughness remarkably.

(6) When a continuous casting process (CC) is applied for the slab production, Nb(CN) precipitates at the grain boundaries of the austenite grains to cause the intergranular embrittlement which leads to surface crackings of the steel slab.

The present inventors have conducted extensive studies for many years for development of a steel composition which overcomes the above defects of the conventional Nb-steels and still has the advantageous precipitation hardening property and the refinement of grains achieved by the conventional Nb-steels, and have found that addition of a very small amount of Mo is most effective for the purpose. However, it has been found that some molybdenum containing steel compositions show remarkable embrittlement when it is subjected to a warm rolling under certain rolling conditions. Then the present inventors continued to make studies also on the rolling conditions which cause the above embrittlement, and finally succeeded in developing the present steel sheet suitable for gas line pipes having excellent DWTT property.

SUMMARY OF THE INVENTION

The method for producing a steel product including steel plate sheet, strip, etc. (herein called "steel sheet") according to the present invention comprises a step of heating to a temperature not higher than 1150° C., a steel slab containing 0.01–0.13% G., 0.05–0.8% Si, 0.8–1.8% Mn, 0.01–0.08% total Al, 0.08–0.40% Mo, and not more than 0.015% S with the balance being iron and unavoidable impurities, and a step of hot rolling the steel slab thus obtained by at least three passes with a minimum reduction percentage not less than 2% by each rolling pass in a temperature range of 900°–1050° C., a total reduction percentage not less than 50%, and with a finishing temperature not higher than 820° C.

The steel slab composition may be modified as further containing at least one of 0.02–0.20% V, 0.001–0.03%

REM, 0.0005–0.03% Ca, 0.004–0.03% Ti, not more than 0.6% Cr, not more than 0.6% Cu and not more than 2.5% Ni, and also may be modified so as to limit the nitrogen content to a range of 0.001 to 0.009% when Ti is added, and satisfying the REM/S ratio of 1.0–6.0 when REM is contained.

DETAILED DESCRIPTION OF THE INVENTION:

The present invention will be described in more details referring to the attached drawings.

According to the results of the studies and experiments conducted by the present inventors, Mo addition in a very small amount increases the tensile strength (TS) and the yield strength (YS) due to its hardening improvement effect, lowers the yield ratio (YR), and under certain conditions in the high-temperature zone during the rolling it is remarkably effective to refine the recrystallized rolled austenite grains while in the temperature range below 900° C. it is, similarly as Nb and V, effective to elongate the rolled austenite grains and to refine the rolled structure. What should be noted particularly in this connection is that the recrystallization preventing characteristic of Mo is less strong than that of Nb but is stronger than that of V depending on the amount of Mo addition, and the heating and rolling conditions.

For the above excellent properties of Mo, the recrystallized rolled austenite grains can be refined more remarkably in the Mo-containing steel than in the Nb-steels, and the recrystallized rolled austenite grains can be elongated by rolling at 900° C. or lower in the Mo-containing steel so that a very fine rolled structure with considerably less mixed grains can be achieved.

Also, the Mo-containing steel has an advantage over the V-steels in that Mo, contrary to V, is remarkably effective to refine the rolled austenite grains in the high-temperature zone, and that the rolled austenite grains can be elongated and hence a fine rolled structure can be achieved even if the rolling is not performed at so low temperatures because Mo is stronger than V in preventing the recrystallization.

Further advantages of the present steel, are that;

(1) there is no heating problem inherent to the Nb-steels because no Nb is contained, and a very stable balance can be obtained between the strength and the toughness;

(2) the steel composition is suitable for continuous casting and when the slab is produced by a continuous casting process, there is no problem of surface cracking; and (3) the yield ratio (YR) is 2–10% lower than that of the Nb-steels depending on the content of Mo (although influenced by contents of C and Mn) so that the pipe manufacturing such as the UO forming process is easily done, that deterioration of the yield strength (YS) due to Bauschinger effect is less or the yield strength increases in some steel compositions.

In order to make full use of the merits of Mo as mentioned above, and in order to achieve the advantageous properties for the pipe line steel sheets, namely the strength, toughness, weldability of the steel sheet as a base material, the toughness and resistance to hydrogen cracking of the welded portion, it is essential to define the Mo content in an optimum range.

Figure 1:
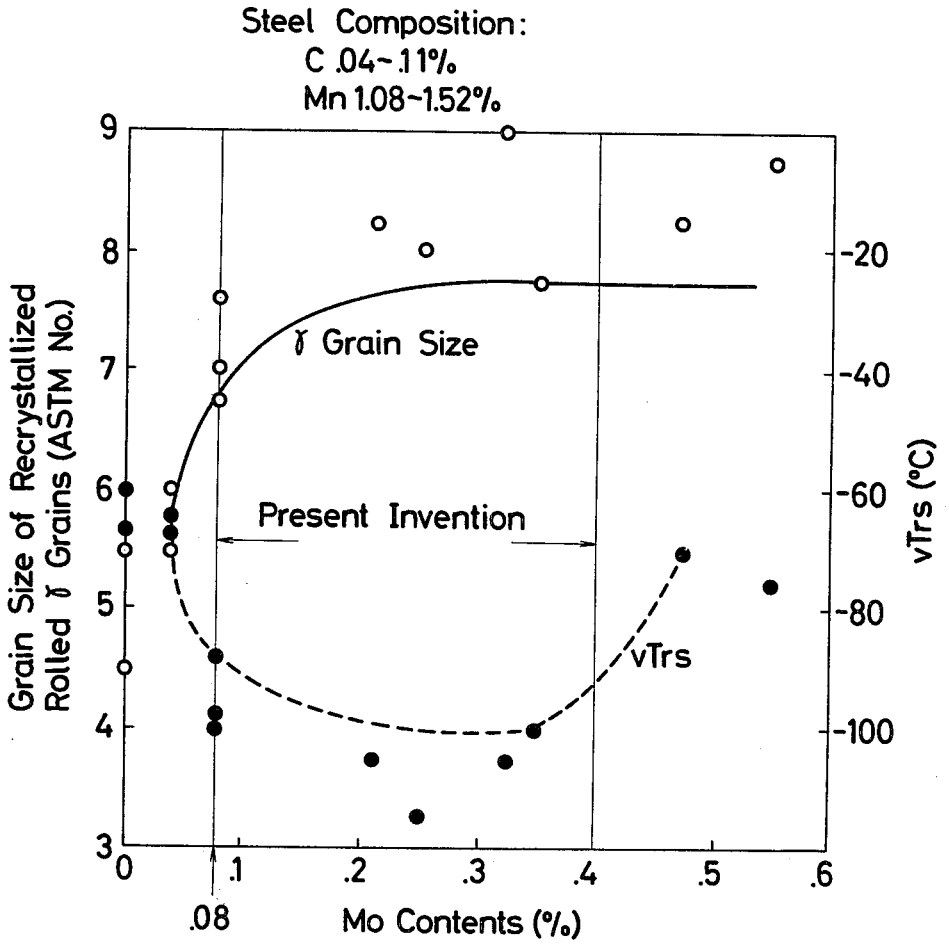
FIG. 1 is a graph showing the effects of the molybdenum contents on the recrystallized rolled austenite grains and vTrs values.

FIG. 1 shows the relation between the contents of Mo and the grain size of the rolled austenite grains, and it is clear from the graph that with Mo contents less than 0.08%, there is no practical effect of refining the rolled austenite grains and thus at least 0.08% of Mo content is necessary for the purpose, but on the other hand with Mo contents exceeding 0.40% a large amount of bainite or island martensite structure are produced in the rolled structure although the rolled austenite grains are refined remarkably, so that deterioration of the toughness is considerable and the resistance to hydrogen cracking deteriorates in spite of the increase of the tensile strength. Thus the upper limit of the Mo content is set at 0.40%.

Meanwhile, regarding the recrystallization preventing effect of Mo, it has been revealed by the studies and experiments conducted by the present inventors that the recrystallization temperature increases as the Mo content increases, but with 0.08% of Mo the rolled austenite grains are elongated by rolling at 900° C. or lower and thus this level of Mo content is effective to refine the rolled structure. Therefore, 0.08 to 0.40% of Mo is desirable.

As described above, in order to make full use of the advantages of Mo-steels, it is also necessary to limit the heating and rolling conditions.

It has been found through the extensive studies conducted by the present inventors that the austenite grains become coarse once the rolling is done with a light reduction less than 2% in the temperature range from 1050° to 900° C. so that the total effects of the subsequent high-reduction rolling passes are reduced by almost half and the refinement of the austenite grains is hardly achieved, thus failing to obtain a desired high toughness of the final product. It has been further found that three or more rolling passes each with a reduction exceeding 5% are given in the temperature range from 1050° to 900° C., the recrystallized grains are refined still further so that the rolled austenite grains are refined with improvements of DWTT property.

The reduction amount used in the present invention has the following definition.

$$\text{Reduction amount (\%)} = \frac{\text{Thickness before reduction} - \text{Thickness after reduction}}{\text{Thickness before reduction}} \times 100$$

In Mo-steels, the embrittlement phenomena can not be eliminated and satisfactory low-temperature toughness can be assumed unless the rolled austenite grains are refined and elongated and the rolled structure is refined.

For this reason, it is necessary to reduce the heated austenite grains as small as possible.

Figure 2:
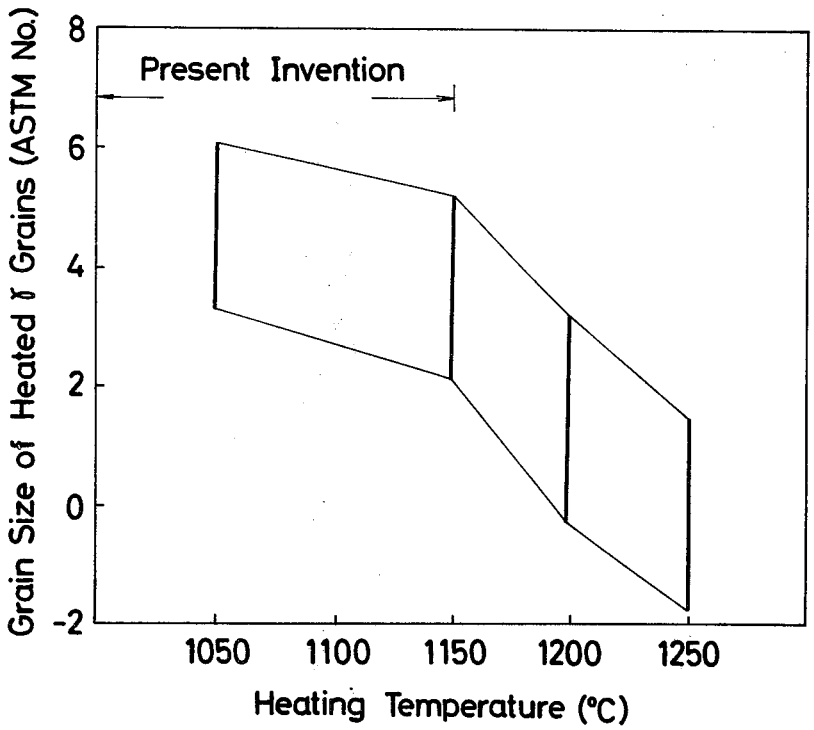
FIG. 2 is a graph showing the relation between heating temperature and the heated austenite grain size when the present steel (Table 1, B) is heated to various temperatures and held for 60 minutes at the respective temperatures.

FIG. 2 is a graph showing the relation between the heating temperature and the heated austenite grains, and it is clear from this graph that the heating should be done at a temperature not higher than 1150° C. preferably in a range from 1050° to 1150° C., and in view of the possible coarsening of the heated austenite grains due to elongation of the holding time during the heating, it is desirable that the holding time is 2 hours or less.

It is necessary to refine further the heated austenite grains thus refined by rolling in the recrystallization zone into finer rolled austenite grains (not less than ASTM No. 6).

Figure 3:
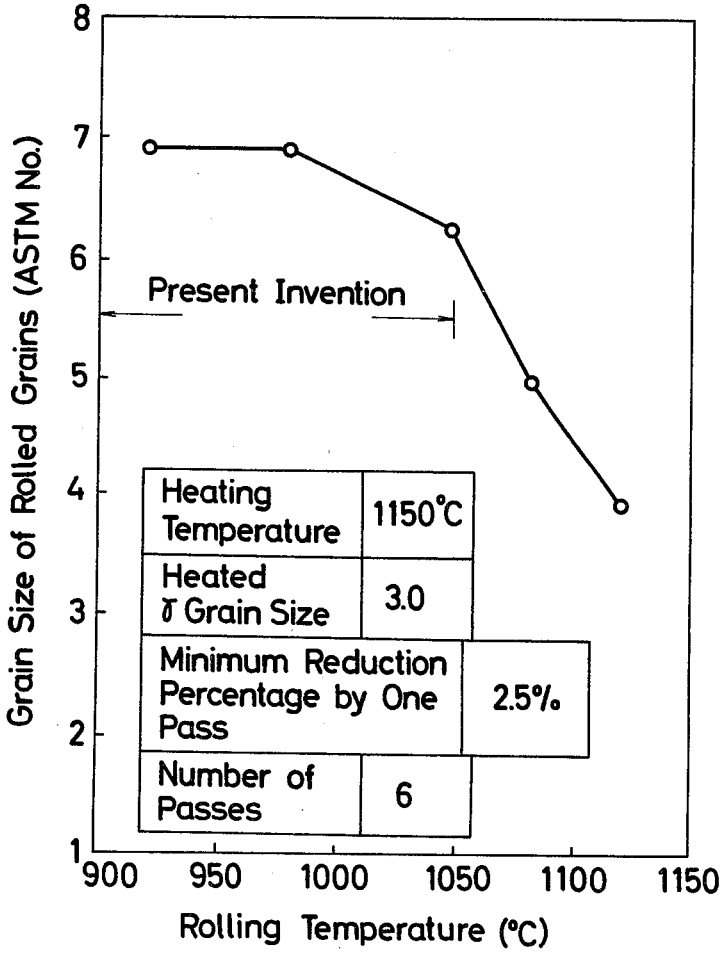
FIG. 3 is a graph showing the relation between the rolling temperature and the rolled austenite grain size under a certain rolling condition.

FIG. 3 is a graph showing the relation between the rolling temperatures under the same rolling condition and the grain size of the rolled austenite grains, and it is clearly understood from the graph that when the rolling is done in the temperature range from 1050° to 900° C., the rolled austenite grains thus obtained are equal or finer than ASTM No. 6. Therefore, the rolling temperature in the recrystallization zone is preferably from 1050° to 900° C. It is very natural that the rolling may be done at a temperature above 1050° C. and then in the temperature range from 1050° to 900° C.

Figure 4:
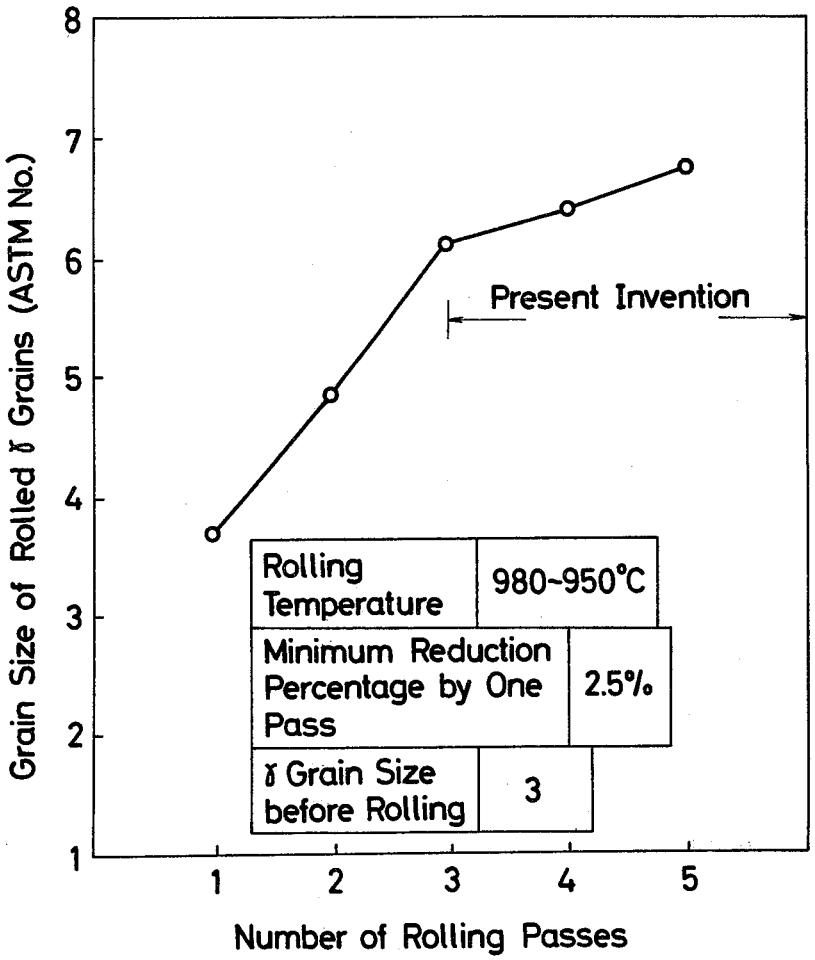
FIG. 4 is a graph showing the relation between the number of rolling passes in the temperature range of 950° to 980° C. and the rolled austenite grain size.

FIG. 4 is a graph showing the relation between the number of the rolling passes under the same rolling condition and the grain size of the rolled austenite grains thus obtained.

It is clear from the graph that no satisfactory refinement of the recrystallized rolled austenite grains can be achieved, unless at least three rolling passes are given. Also regarding the reduction percentage per one rolling pass in the temperature range from 1050° to 900° C., it has been revealed by the studies conducted by the present inventors that the effect of the reduction percentage on the grain size of the recrystalized rolled austenite grains is generally small in the Mo-steels, but when the minimum reduction in the above temperature range is less than 2%, the hot deformation of the austenite grains is not enough and the grains which have coarsened after the reduction can not be refined any more however large reduction is given subsequently.

From the above findings, it is necessary in the present invention to give rolling reductions each with a reduction percentage exceeding 2% in the temperature range from 1050° to 900° C.

Figure 5:
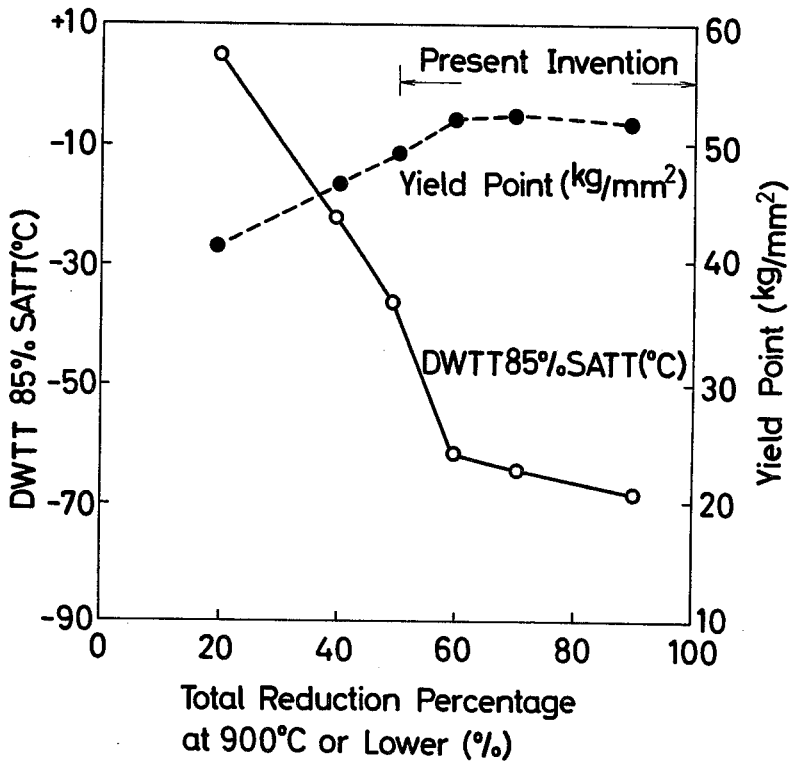
FIG. 5 is a graph showing the relation between the reduction amount at a temperature not higher than 900° C., and the yield point and DWTT 85% SATT value in the present steel (Table 1, C).

Then it is necessary to refine the elongated rolled structure by rolling the fine recrystallized rolled austenite grains in the non-recrystallization zone not higher than 900° C. For this purpose, it is necessary that the total reduction percentage in the non-recrystallization zone is not less than 50%. When the total reduction percentage at 900° C. or lower is 50% or more, the yield point and toughness are considerably improved as shown in FIG. 5, while with the total reduction percentage less than 50%, it is not possible to maintain the transition temperature of 85% brittle fracture characteristic in the Drop Weight Tear Test (DWTT 85% SATT) at −30° C. or lower as desired by the present invention.

Figure 6:
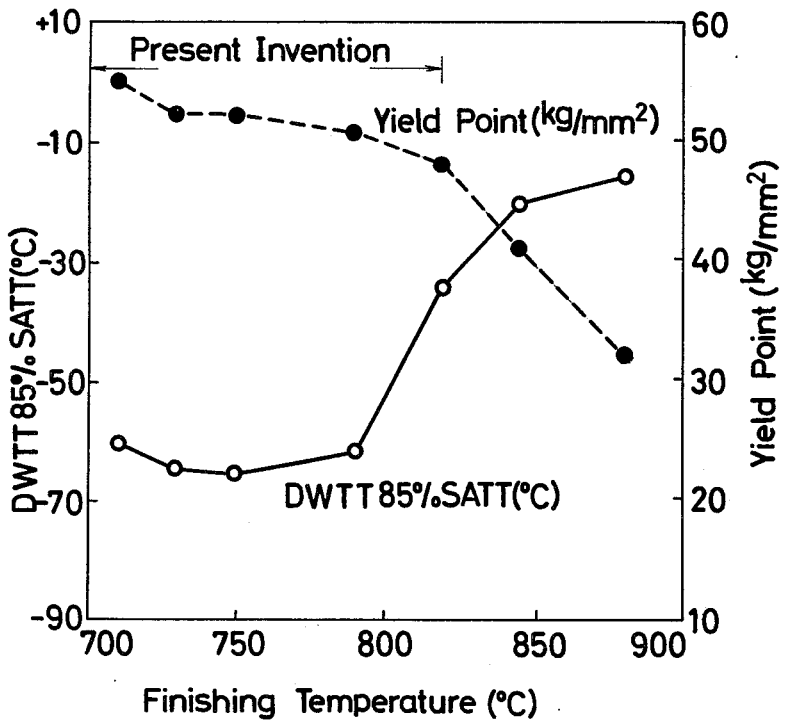
FIG. 6 is a graph showing the relation between the finishing temperature and the yield point and DWTT 85% SATT values in the present steel (Table 1, C).

On the other hand, even when the total reduction percentage at 900° C. or lower is not less than 50%, not only the desired DWTT property can not be obtained, but also enough strength can not be achieved, if the finishing temperature is at 820° C. or higher as shown in FIG. 6.

On the basis of the above findings, the rolling conditions in the non-recrystallization zone are defined in the present invention as that a total reduction not less than 50% is given at a temperature not higher than 900° C. and the finishing temperature is not higher than 820° C.

Meanwhile, regarding the rolling temperature just or several passes before the finishing rolling pass, it has been confirmed through experiments that a good low-temperature toughness can be achieved even when the temperature is partially below the $Ar_3$ transformation point, if the steel composition and the rolling conditions are within the scope of the present invention.

Therefore, the rolling partially in the dual-phase ($\gamma - \alpha$) zone is within the scope of the present invention.

It should be also understood that the steel sheet after the rolling may be heated to a temperature not higher than the $AC_1$ point and cooled for the purpose of dehydrogenation, etc. Without deviating from the scope of the present invention. In this case, the island martensite, etc. is decomposed to cementite and the yield point increases, while the tensile strength lowers to improve the toughness, and also the resistance to hydrogen cracking is improved. Therefore, such heating as above is rather desirable in case of thick plate materials.

Following description will be made on the reason for the limitations of various elements in the steel composition according to the present invention.

The basic steel composition according to the present invention comprises:

C: 0.01–0.13%
Si: 0.05–0.8%
Mn: 0.8–1.80%
Total Al: 0.01 to 0.08%
S: not more than 0.015%, and
Mo: 0.08–0.40%

The lower limit of the carbon content is defined as the minimum amount required for the required refinement of the base steel structure and assuring the required strength of the welded portion as well as for assuring that carbide forming elements, such as V, can exert fully their effects. On the other hand, when the carbon content is excessively large, a large amount of bainite and island martensite is formed even with Mo contents within the range from 0.80 to 0.40% to have adverse effects on the toughness and to lower the weldability. Thus the upper limit of the carbon content is set at 0.13%. In order to eliminate the adverse effects on the toughness of the seggregation zone, not more than 0.1% of carbon is desirable.

Silicon is inevitably contained as a deoxidizing agent in the steel and silicon contents less than 0.05%, the toughness of the base steel deteriorates and thus the lower limit of the silicon content is set at 0.05%. On the other hand, excessive silicon contents have adverse effect on the cleanness of the steel and therefore the upper limit of the silicon content is set at 0.8%.

Manganese is an important element for maintaining the required strength and toughness of the low-carbon steel according to the present invention. Manganese contents less than 0.8%, the strength and toughness lower, and therefore, the lower limit of the manganese content is set at 0.8% in the present invention. On the other hand, with excessive manganese contents, the hardenability of HAZ increases and a considerable amount of bainite or island martensite is formed to deteriorate the toughness of the base steel and HAZ. Therefore in the present invention, the upper limit of the manganese content is set at 1.8%.

Aluminum is inevitably contained in a killed steel as in the present invention from the deoxidation, and total aluminum contents less than 0.01% the deoxidation is not satisfactory and the toughness of the base steel deteriorates. Therefore, the lower limit of the aluminum content is set at 0.01% in the present invention. On the other hand, when the total aluminum content exceeds 0.08%, not only the HAZ toughness but also the toughness of the weld metal lower remarkably. Therefore, the upper limit of the total aluminum content is set at 0.08%.

As for the reason for limiting the sulfur content, as an impurity, to not more than 0.015% in the present invention, a high degree of Charpy impact values is required both for the base steel and HAZ in case of steel pipes for the gas pipe line, but striation phenomena take place on the impact fracture surface of a CR steel and improves the brittle fracture characteristic but lowers the impact value, and thus in order to improve the impact value, it is particularly effective to maintain the sulfur content in an amount not more than 0.015%. In this case, it is natural that with a lower sulfur content, a more improved Charpy test toughness is obtained, and not more than 0.008% sulfur is desirable for obtaining stably a high level of absorbed energy.

Phosphorus is contained as an impurity in the steel according to the present invention, normally in an amount not more than 0.03%, and phosphorus is not intentionally added in the present invention, but a lower phosphorus content improves the toughness.

According to a modification of the present invention, the basic steel composition may further comprise at least one of not more than 0.20% V, not more than 0.6% Cr, not more than 0.6% Cu and not more than 2.5% Ni.

Vanadium is added for the purpose of improving the strength and toughness of the base steel and for increasing the steel sheet thickness for production range and the required strength of the welded portion, and the addition of vanadium in combination is particularly effective to improve the strength and toughness. Thus, in recent gas line pipes which are required to have a high level of tensile strength and an increased thickness and simultaneously a satisfactory low-temperature toughness, it is not possible to maintain 40 kg/mm$^2$ or more of yield strength (equivalent to X-65–X-70) by the molybdenum addition alone, and the rolled austenite grains are still further refined when molybdenum is added under the presence of vanadium which has less recrystallization preventing characteristic than molybdenum, and the rolled austenite grains are elongated more smoothly in the non-crystallization zone so that the rolled structure can be refined finer. However, with vanadium contents exceeding 0.20%, precipitated V(CN) is not easily dissolved stably into solid solution at a heating temperature of 1150° C. or lower and the toughness of the base metals as well as HAZ deteriorates. Therefore, in the present invention, the upper limit of the vanadium content is set at 0.02%. For maintaining the desired strength and toughness, 0.02% or more vanadium is desirable.

Chromium, copper and nickel are added mainly for the purpose of improving the strength and toughness of the base metals, and increasing the steel sheet thickness for production range, and their contents are naturally limited to a certain amount, but in the low-carbon steel without addition of niobium according to the present invention, their upper limits can be raised higher than that those in an ordinary carbon steel.

Chromium, when present in an excessive amount, increases the hardenability of HAZ and lowers the toughness and the resistance to the welding cracks, and therefore the upper limit of the chromium content is 0.6%.

Nickel up to a certain amount can improve the strength and toughness of the base metal without adverse effects on the hardenability and toughness of HAZ, but nickel contents exceeding 2.5% have adverse effects on the hardenability and toughness of HAZ. Therefore, the upper limit of the nickel content is set at 0.5% in the present invention. Further, in order to improve the stress corrosion resistance in hydrogen sulfide media less than 1.0% nickel is desirable.

Copper has similar effects as nickel and is favourable for corrosion resistance, but copper contents exceeding 0.6% cause copper-cracks during the sheet rolling resulting in difficulties in the production. Therefore, the upper limit of the copper content is set at 0.6% in the present invention.

Regarding the lower limits of chromium, nickel and copper, 0.1% is desirable for fully obtaining their addition effects.

According to further modifications of the present invention, the base steel composition and the modified steel composition defined hereinbefore may further comprise at least one of 0.001 to 0.03% REM (Rare Earth Metal), 0.0005 to 0.03% Ca, and 0.004 to 0.03% Ti, and when titanium is added, the nitrogen content is limited to a range of 0.001 to 0.009%, and when REM is added the REM/S ratio is limited to a range of 1.0 to 6.0. By the above modifications still further improved toughness can be achieved.

Both of REM and Ca are effective to spheroidize MnS and prevent the elongation of MnS during the CR, thus contributing not only to improve the toughness in the direction perpendicular to the rolling direction, but also to prevent Ultrasonic Testing defects caused by the elongated large MnS and hydrogen in steel.

Regarding the content of REM, less than 0.001% produces no practical effect, but more than 0.03% it causes not only enlargement of REM-sulfide, but also a large amount of REM-oxysulfide which exists as a large size inclusions, thus remarkably damaging not only the toughness but also the cleanness of the steel sheet. Therefore, in the present invention, the REM content is limited to the range of 0.001 to 0.03%.

Meanwhile, REM is effective to improve and stabilize the toughness of the steel sheet in co-relation with the sulfur content, and an optimum REM content for this purpose is defined by the REM/S ratio ranging from 1.0 to 6.0.

Calcium has similar effects as REM and its content is limited to the range from 0.0005 to 0.03%.

Titanium is added in the present invention for the purpose of dispersing fine TiN in the steel slab before heating, so as to achieve refinement of the heated austenite grains. In the steel compositions containing no niobium according to the present invention, the recrystallization takes place down to low temperature and the recrystallized rolled austenite grains are refined remarkably by molybdenum, so that if the heated austenite grains are maintained fine, the recrystallized rolled austenite grains are refined further and the low-temperature toughness is improved still further. For this purpose, fine TiN must be dispersed in the steel slab as much as possible, preferably 0.004% or more TiN, not larger than 0.02μ. However, in the ordinary ingot making process, the solidification and cooling speed is so slow that TiN is apt to precipitate in a coarse size and it is difficult to obtain stably the fine TiN required for the refinement of the heated austenite grains. Therefore, for a commercial production, a continuous casting process is preferable. In this case, however, excessive titanium contents cause precipitation of coarse TiN, and therefore, the upper limit of the TiN content is set at 0.03%. On the other hand, titanium contents less than 0.004%, no practical effect of refining the heated austenite grains can be obtained, and therefore the lower limit of the titanium content is set at 0.004%.

Further, in order to obtain the fine TiN more effectively, it is advantageous to limit the nitrogen content in relation with the titanium content, preferably to a range from 0.001 to 0.009%. Meanwhile, when titanium is present more than the chemical equivalent to nitrogen, TiC harmful to the toughness is formed. Therefore, it should be avoided that titanium is contained more than the chemical equivalent to N.

Regarding the hot rolling in the present invention, a heavy plate rolling mill is most desirable, but a hot strip mill may be advantageously used.

Embodiments of the present invention are illustrated in Table 1 to Table 4 from which it is clear that the steel sheets obtained by the present invention are very excellent not only in the base steel properties, such as strength and toughness, but also the toughness and resistance to hydrogen cracking of the welded portion.

The steel sheet produced according to the present invention can be also used for general applications requiring low-temperature toughness other than the pipes.

Table 1 o : Present Invention

| Classification | Steels | Chemical Composition (%) C | Si | Mn | S | Mo | V | Al | N | Others |
|---|---|---|---|---|---|---|---|---|---|---|
| | A-1 | 0.08 | 0.26 | 1.34 | 0.004 | 0.26 | 0.078 | 0.030 | 0.0050 | Ni 0.25 |
| | A-2 | " | " | " | " | " | " | " | " | " |
| o | A-3 | " | " | " | " | " | " | " | " | " |
| | B-1 | 0.05 | 0.10 | 1.65 | 0.003 | 0.28 | 0.060 | 0.025 | 0.0055 | Ti 0.014<br>REM 0.009 |
| | B-2 | " | " | " | " | " | " | " | " | " |
| o | B-3 | " | " | " | " | " | " | " | " | " |
| | C-1 | 0.09 | 0.20 | 1.50 | 0.003 | 0.20 | — | 0.020 | 0.0060 | Ti 0.013<br>Ca 0.008 |
| | C-2 | " | " | " | " | " | — | " | " | " |
| | C-3 | " | " | " | " | " | — | " | " | " |
| o | C-4 | " | " | " | " | " | — | " | " | " |
| | D-1 | 0.06 | 0.20 | 1.35 | 0.002 | 0.30 | 0.050 | 0.030 | 0.0040 | Ni 0.80<br>Cr 0.20<br>REM 0.011 |
| | D-2 | " | " | " | " | " | " | " | " | " |
| | D-3 | " | " | " | " | " | " | " | " | " |
| o | D-4 | " | " | " | " | " | " | " | " | " |
| | E-1 | 0.10 | 0.15 | 1.45 | 0.003 | 0.08 | — | 0.025 | 0.0025 | — |
| | E-2 | " | " | " | " | " | — | " | " | — |
| o | E-3 | " | " | " | " | " | — | " | " | — |
| o | E-4 | " | " | " | " | " | — | " | " | — |
| | F-1 | 0.03 | 0.15 | 1.50 | 0.003 | 0.25 | 0.050 | 0.028 | 0.0060 | Ni 0.20<br>Cu 0.25<br>Ti 0.010<br>REM 0.010 |
| | F-2 | " | " | " | " | " | " | " | " | " |
| o | F-3*1) | " | " | " | " | " | " | " | " | " |
| o | F-4 | " | " | " | " | " | " | " | " | " |
| | G-1 | 0.09 | 0.30 | 1.43 | 0.004 | 0.20 | 0.040 | 0.035 | 0.0055 | Nb 0.04 |
| | G-2 | " | " | " | " | " | " | " | " | " |
| | G-3 | " | " | " | " | " | " | " | " | " |
| | G-4 | " | " | " | " | " | " | " | " | " |
| | H-1 | 0.05 | 0.25 | 1.40 | 0.003 | — | 0.025 | 0.025 | 0.0060 | Ni 0.70<br>Cu 0.26<br>REM 0.010 |
| | H-2 | " | " | " | " | — | " | " | " | " |
| | H-3 | " | " | " | " | — | " | " | " | " |
| o | I | 0.09 | 0.20 | 1.50 | 0.004 | 0.27 | 0.080 | 0.028 | 0.0070 | — |
| o | J | 0.06 | 0.25 | 1.55 | 0.003 | 0.10 | — | 0.030 | 0.0045 | Ti 0.012<br>Ca 0.0008<br>Cu 0.28<br>Ni 0.90 |
| o | K | 0.08 | 0.20 | 1.50 | 0.003 | 0.20 | — | 0.020 | 0.0055 | Ti 0.014 |

Table 1-continued

| Classification | Steels | Method*2) of Slab Production | Sheet Production Conditions: Heating Temp. (° C) | Heated γ Grain Size (ASTM No.) | In the Temp. Range of 900–1050° C.: Number of Passes | Reduction Percentage of Each Pass (in Time Sequence) (%) | Reduction Percentage at 900° C or lower (%) | Finishing Temp. (° C) | Rolled γ Grain Size (ASTM No.) | Sheet Thickness (mm) |
|---|---|---|---|---|---|---|---|---|---|---|
| | A-1 | IG | 1150 | 3.0 | 6 | 3.5, 2.5, 1.5, 2.5, 2.8, 4.1 | 60 | 740 | 4.5 | 20 |
| | A-2 | " | " | " | 6 | 3.0, 1.0, 6.0, 20.5, 4.5, 4.0 | 60 | 730 | 5.0 | 20 |
| o | A-3 | " | " | " | 6 | 2.5, 4.0, 3.5, 4.5, 3.5, 4.0 | 59.5 | 740 | 6.5 | 20 |
| | B-1 | CC | 1150 | 4.0 | 5 | 1.7, 2.8, 3.5, 4.0, 3.5 | 85 | 760 | 5.0 | 32 |
| | B-2 | " | " | " | 5 | 2.5, 1.6, 9.5, 10.0, 4.0 | 80 | 760 | 5.5 | 32 |
| o | B-3 | " | " | " | 5 | 3.0, 4.5, 5.0, 5.5, 3.5 | 84 | 750 | 7.0 | 32 |
| | C-1 | IG | 1080 | 4.5 | 5 | 2.5, 1.9, 4.5, 6.5, 5.0 | 65 | 740 | 5.0 | 16 |
| | C-2 | " | " | " | 6 | 5.0, 4.0, 4.5, 4.5, 4.0, 3.5 | 40 | 750 | 5.5 | 16 |
| | C-3 | " | " | " | 6 | 4.5, 5.0, 4.5, 5.0, 4.5, 4.0 | 70 | 840 | 5.9 | 16 |
| o | C-4 | " | " | " | 6 | 5.0, 4.0, 4.5, 5.0, 4.5, 4.5 | 70 | 750 | 7.0 | 16 |
| | D-1 | IG | 1150 | 3.0 | 7 | 2.5, 1.0, 5.0, 4.5, 3.0, 2.5, 4.5 | 65 | 780 | 4.0 | 20 |
| | D-2 | " | " | " | 7 | 8.5, 9.0, 1.5, 4.5, 2.5, 4.0, 1.8 | 60 | 760 | 5.0 | 20 |
| | D-3 | " | 1250 | 2.0 | 8 | 3.5, 4.5, 5.0, 4.5, 4.0, 4.5, 4.0, 4.5 | 75 | 750 | 4.5 | 20 |
| o | D-4 | " | 1150 | 3.0 | 9 | 5.5, 2.5, 3.5, 5.0, 4.0, 5.5, 4.0 | 70 | 760 | 7.0 | 20 |
| | E-1 | CC | 1150 | 3.5 | 6 | 2.5, 1.5, 6.0, 3.5, 4.0, 5.0 | 40 | 835 | 4.5 | 26 |
| | E-2 | " | 1200 | 2.5 | 6 | 5.0, 4.5, 4.0, 6.0, 6.5, 3.5 | 60 | 760 | 5.5 | 26 |
| o | E-3 | CC | 1150 | 3.5 | 6 | 2.5, 2.5, 4.0, 5.5, 4.5, 5.0 | 70 | 750 | 7.0 | 26 |
| o | E-4 | " | 1150 | 3.5 | 6 | 4.5, 5.0, 4.5, 4.5, 4.0, 6.0 | 80 | 660 | 7.5 | 26 |
| | F-1 | IG | 1150 | 4.5 | 8 | 10.0, 5.0, 1.9, 3.5, 2.0, 4.5, 4.0, 3.5 | 70 | 760 | 5.5 | 20 |
| | F-2 | " | " | " | 7 | 3.5, 4.0, 6.5, 8.0, 3.5, 10.0, 3.5, 4.0 | 40 | 780 | 5.9 | 20 |
| o | F-3*1) | " | " | " | 9 | 3.6, 4.0, 5.0, 4.5, 4.0, 3.0, 4.0, 3.5, 3.8 | 60 | 760 | 7.0 | 20 |
| o | F-4 | " | " | " | 8 | 4.5, 4.0, 3.0, 4.5, 4.5, 4.5, 4.0, 5.0 | 70 | 780 | 8.0 | 20 |
| | G-1 | IG | 1150 | 2.5 | 6 | 3.5, 1.8, 4.5, 5.0, 3.0, 3.5 | 70 | 720 | 4.5 | 32 |
| | G-2 | " | " | " | 6 | 1.9, 6.0, 8.0, 3.5, 4.0, 3.5 | 75 | 750 | 4.5 | 32 |
| | G-3 | " | " | " | 6 | 4.5, 5.0, 4.0, 3.5, 4.0, 4.5 | 60 | 740 | 5.5 | 32 |
| | G-4 | " | " | " | 5 | 1.0, 1.5, 8.5, 10.5, 0.5 | 75 | 745 | 5.8 | 32 |
| | H-1 | CC | 1080 | 2.8 | 7 | 2.8, 1.6, 4.0, 3.5, 2.5, 3.5, 3.0 | 70 | 780 | 4.0 | 16 |
| | H-2 | " | " | " | 7 | 4.0, 3.0, 4.5, 4.0, 5.0, 5.0, 4.5 | 70 | 765 | 5.5 | 16 |
| | H-3 | " | " | " | 6 | 1.5, 8.0, 1.5, 3.5, 8.0, 2.5 | 75 | 760 | 5.6 | 16 |
| o | I | IG | 1150 | 3.0 | 5 | 2.5, 3.0, 5.0, 6.0, 4.5 | 70 | 730 | 6.0 | 20 |
| o | J | CC | 1150 | 4.0 | 5 | 2.0, 8.0, 5.0, 4.0, 3.5 | 65 | 740 | 6.5 | 13.7 |
| o | K | CC | 1000 | 4.5 | 6 | 5.0, 4.0, 3.5, 4.5, 6.0, 4.0 | 70 | 740 | 6.5 | 16 |

| Classification | Steels | Properties of Base Metal *3): Tensile Properties: Yield Point (kg/mm²) | Tensile Strength (kg/mm²) | Elongation (%) | 2mmV Charpy Impact Properties: vE-60° C(kg-m) | vTrs(° C) | DWTT*4) 85% SATT (° C) | Impact Absorbed Energy in Welded Portion -40° C, 2mmV Notch Charpy (kg-m) | Number of Cross Sectional Cracks in Hydrogen Cracking Resistance Test (mm) |
|---|---|---|---|---|---|---|---|---|---|
| | A-1 | 46.5 | 58.1 | 42 | 4.8 | −40 | −5 | 8.0 | 3 |
| | A-2 | 47.1 | 59.0 | 42 | 6.1 | −50 | −10 | 7.0 | 2 |
| o | A-3 | 49.1 | 61.5 | 41 | 14.2 | −105 | −40 | 8.5 | 2 |
| | B-1 | 48.1 | 61.0 | 48 | 6.0 | −50 | +10 | 14.1 | 2 |
| | B-2 | 49.0 | 61.5 | 46 | 7.1 | −60 | 0 | 13.8 | 2 |
| o | B-3 | 51.5 | 63.0 | 49 | 18.1 | −125 | −40 | 14.9 | 1 |
| | C-1 | 46.1 | 57.5 | 36 | 6.0 | −30 | −10 | 9.5 | 2 |
| | C-2 | 47.1 | 58.1 | 38 | 6.5 | −40 | −21 | 9.8 | 3 |
| | C-3 | 41.5 | 54.6 | 36 | 6.8 | −50 | −20 | 9.0 | 2 |
| o | C-4 | 51.2 | 60.1 | 37 | 14.5 | −100 | −65 | 10.6 | 1 |
| | D-1 | 50.6 | 61.6 | 40 | 4.0 | −40 | −5 | 12.1 | 3 |
| | D-2 | 50.4 | 61.9 | 41 | 3.8 | −50 | −10 | 12.0 | 3 |
| | D-3 | 51.2 | 62.1 | 42 | 6.0 | −70 | −25 | 11.4 | 4 |
| o | D-4 | 51.8 | 63.0 | 42 | 10.5 | −120 | −50 | 11.8 | 2 |
| | E-1 | 46.1 | 58.1 | 36 | 5.1 | −50 | 0 | 8.5 | 6 |
| | E-2 | 47.5 | 58.6 | 38 | 6.8 | −60 | −10 | 8.8 | 4 |
| o | E-3 | 48.9 | 59.0 | 38 | 11.6 | −105 | −40 | 9.0 | 3 |
| o | E-4 | 48.0 | 58.9 | 39 | 12.8 | −100 | −45 | 9.5 | 2 |
| | F-1 | 50.1 | 60.1 | 38 | 9.1 | −70 | −20 | 15.1 | 2 |
| | F-2 | 50.6 | 60.0 | 39 | 9.8 | −75 | −20 | 16.2 | 1 |
| o | F-3*1) | 53.5 | 62.5 | 40 | 24.5 | −140 | −70 | 16.0 | 0 |
| o | F-4 | 51.9 | 64.1 | 40 | 22.5 | −120 | −60 | 16.4 | 1 |
| | G-1 | 50.5 | 62.5 | 43 | 4.8 | −45 | +5 | 4.5 | 5 |
| | G-2 | 51.0 | 62.8 | 46 | 4.9 | −50 | +2 | 4.8 | 8 |
| | G-3 | 51.1 | 63.4 | 44 | 5.1 | −50 | 0 | 4.4 | 6 |
| | G-4 | 52.5 | 64.1 | 44 | 5.9 | −55 | −10 | 4.6 | 3 |
| | H-1 | 48.5 | 59.1 | 38 | 4.1 | −55 | −8 | 6.2 | 4 |
| | H-2 | 49.1 | 60.2 | 36 | 4.4 | −60 | −10 | 6.4 | 2 |

Table 1-continued

| Classification | Steels | Properties of Base Metal *3) Tensile Properties: Yield Point (kg/mm²) | Tensile Strength (kg/mm²) | Elongation (%) | 2mmV Charpy Impact Properties: vE-60° C(kg-m) | vTrs(° C) | DWTT*4) 85% SATT ° C) | Impact Absorbed Energy in Welded Portion -40° C, 2mmV Notch Charpy kg-m) | Number of Cross Sectional Cracks in Hydrogen Cracking Resistance Test (mm) |
|---|---|---|---|---|---|---|---|---|---|
| | H-3 | 50.0 | 61.4 | 38 | 5.1 | −65 | −15 | 6.9 | 5 |
| o | I | 46.0 | 57.5 | 42 | 10.1 | −95 | −35 | 8.2 | 2 |
| o | J | 46.5 | 56.4 | 38 | 20.6 | −105 | −45 | 15.0 | 0 |
| o | K | 43.5 | 54.6 | 43 | 15.1 | −100 | −40 | 14.0 | 1 |

*1) F-3 was subjected to heating at 530° C for 10 minutes to remove the hydrogen immediately after the rolling

*2) CC: Continuous Casting Process; IG: Ingot Making Process

*3) Properties of the base metal are expressed by values in the direction perpendicular to the final rolling direction.

Figure 7:
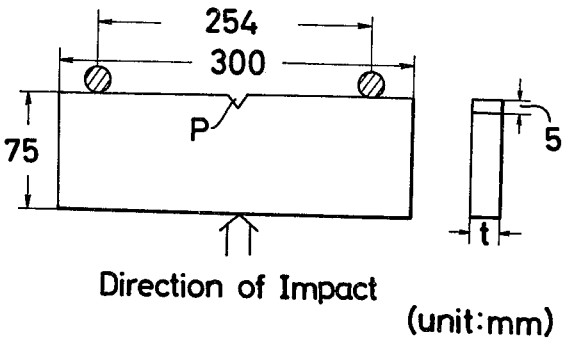
FIG. 7 shows shapes and sizes of test pieces for DWTT (the Drop Weigh Ttear Test according to API).
Figure 8:
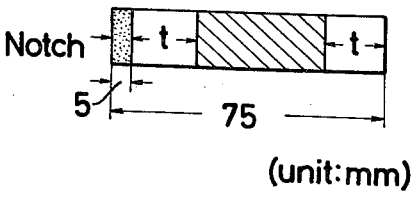
FIG. 8 illustrates how the fracture of the test piece is observed.

*4) 85% ductility-fracture transition temperature (API standard), namely the temperature at which the ductility-fracture ratio is 85%. Refer to Fig. 7 and Fig. 8.

Table 2

| Classification | Steels | Chemical Composition (%): C | Si | Mn | S | Mo | Nb | V | Al | N | Method*1) of Slab Production |
|---|---|---|---|---|---|---|---|---|---|---|---|
| Present Invention | 1 | 0.09 | 0.37 | 1.32 | 0.004 | 0.12 | — | — | 0.022 | 0.0088 | CC |
| | 2 | 0.04 | 0.25 | 1.10 | 0.003 | 0.10 | — | — | 0.028 | 0.0042 | IG |
| | 3 | 0.08 | 0.16 | 1.22 | 0.009 | 0.17 | — | 0.04 | 0.016 | 0.0097 | IG |
| | 4 | 0.10 | 0.33 | 1.45 | 0.005 | 0.28 | — | 0.05 | 0.033 | 0.0079 | IG |
| | 5 | 0.03 | 0.22 | 1.65 | 0.005 | 0.21 | — | 0.07 | 0.019 | 0.0068 | CC |
| | 6 | 0.09 | 0.37 | 1.32 | 0.004 | 0.12 | — | — | 0.022 | 0.0088 | CC |
| | 7 | " | " | " | " | " | — | — | " | " | CC |
| Comparison | 8 | " | " | " | " | " | — | — | " | " | CC |
| | 9 | 0.15 | 0.21 | 1.40 | 0.008 | 0.45 | 0.02 | — | 0.019 | 0.0090 | IG |
| | 10 | 0.10 | 0.33 | 1.45 | 0.005 | 0.28 | — | 0.05 | 0.033 | 0.0079 | IG |
| | 11 | " | " | " | " | " | — | " | " | " | IG |
| | 12 | 0.06 | 0.32 | 1.80 | 0.007 | 0.35 | 0.04 | 0.15 | 0.022 | 0.0120 | IG |

| Classification | Steels | Sheet-Production Conditions: Heating Temp. (° C) | Heated γGrain Size (ASTM No.) | In the Temp. Range of 900–1050° C: Number of Passes | Reduction Percentage of Each Pass (in Time Sequence) (%) | Reduction Percentage at 900° C or lower (%) | Finishing Temp. (° C) | Rolled γGrain Size (ASTM No.) | Sheet Thickness (mm) |
|---|---|---|---|---|---|---|---|---|---|
| Present Invention | 1 | 1150 | 3.0 | 4 | 8.0, 8.5, 9.0, 15.0 | 75 | 735 | 7.0 | 16 |
| | 2 | 1150 | 3.0 | 7 | 9.0, 8.0, 10.0, 15.0, 8.5, 9.5, 10.0 | 75 | 800 | 6.5 | 8 |
| | 3 | 1150 | 3.5 | 5 | 9.5, 9.0, 12.0, 13.0, 12.5 | 70 | 730 | 7.5 | 16 |
| | 4 | 1100 | 4.0 | 4 | 12.0, 10.0, 15.0, 13.5 | 65 | 745 | 8.0 | 20 |
| | 5 | 1150 | 3.0 | 6 | 8.0, 9.5, 8.0, 15.0, 13.0, 10.5 | 75 | 750 | 7.5 | 20 |
| | 6 | 1300 | 2.0 | 4 | 10.0, 12.5, 10.0, 15.0 | 60 | 740 | 5.0 | 16 |
| | 7 | 1150 | 3.0 | 0 | — | 70 | 735 | 5.5 | 16 |
| | 8 | 1150 | 3.0 | 5 | 3.0, 4.0, 4.5, 5.0, 4.5 | 40 | 840 | 4.5 | 16 |
| Comparison | 9 | 1250 | 0 | 3 | 8.0, 13.5, 15.0 | 60 | 750 | 3.5 | 20 |
| | 10 | 1150 | 3.0 | 4 | 10.0, 12.5, 12.0, 15.0 | 30 | 850 | 4.5 | 16 |
| | 11 | " | 3.0 | 1 | 20.0 | 60 | 760 | 5.0 | 16 |
| | 12 | 1250 | −1.0 | 6 | 10.0, 11.5, 10.5, 15.0, 20.0, 15.0 | 70 | 750 | 4.0 | 20 |

| Classification | Steels | Properties of Base Metal *2) Tensile Properties: Yield Point (kg/mm²) | Tensile Strength (kg/mm²) | Elongation (%) | 2mmV Charpy Impact Properties: vE-60° C (kg-m) | vTrs (° C) | DWTT *3) 85% SATT (° C) |
|---|---|---|---|---|---|---|---|
| Present Invention | 1 | 46.2 | 52.5 | 42 | 13.8 | −102 | −45 |
| | 2 | 43.9 | 50.1 | 38 | 14.2 | −105 | −60 |
| | 3 | 52.1 | 58.5 | 37 | 10.8 | −121 | −65 |
| | 4 | 51.1 | 61.8 | 40 | 10.5 | −110 | −60 |
| | 5 | 48.1 | 61.8 | 42 | 20.3 | −107 | −60 |
| Comparison | 6 | 45.5 | 51.9 | 40 | 5.3 | − 60 | −15 |
| | 7 | 46.9 | 52.3 | 39 | 5.8 | − 75 | −20 |
| | 8 | 36.3 | 46.9 | 54 | 2.9 | − 52 | 0 |
| | 9 | 51.3 | 68.2 | 37 | 1.9 | − 46 | +10 |
| | 10 | 42.5 | 58.8 | 45 | 5.7 | − 41 | +10 |
| | 11 | 52.2 | 61.8 | 37 | 7.4 | − 82 | −20 |
| | 12 | 56.3 | 67.4 | 38 | 8.2 | − 83 | −15 |

*1) Continuous Casting Process; IG: Ingot-making Process

*2) Properties of the base metal are expressed by values in the direction perpendicular to the final direction.

*3) 85% ductility-fracture transition temperature (API standard), namely the temperature at which the ductility-fracture ratio is 85%. Refer to FIG. 7 and FIG. 8.

Table 3

| Classification | Steels | Chemical Composition (%) C | Si | Mn | S | Mo | Nb | V | Cr | Cu | Ni | REM | Ca | Ti | N | REM /S | Method of Slab Production*1) |
|---|---|---|---|---|---|---|---|---|---|---|---|---|---|---|---|---|---|
| Present Invention | 1 | 0.12 | 0.33 | 1.28 | 0.010 | 0.21 | — | — | 0.22 | — | 0.45 | — | — | — | 0.0048 | — | IG |
| | 2 | 0.07 | 0.29 | 1.52 | 0.002 | 0.18 | — | 0.05 | — | 0.25 | 0.21 | — | — | — | 0.0079 | — | IG |
| | 3 | 0.06 | 0.25 | 1.50 | 0.003 | 0.21 | — | 0.07 | — | — | 0.28 | 0.012 | — | — | 0.0055 | 4 | CC |
| | 4 | 0.10 | 0.28 | 1.44 | 0.004 | 0.22 | — | 0.07 | — | 0.25 | — | 0.008 | 0.001 | — | 0.0080 | 2 | IG |
| | 5 | 0.09 | 0.15 | 1.23 | 0.005 | 0.13 | — | — | 0.26 | — | — | — | — | 0.018 | 0.0096 | — | CC |
| | 6*2) | 0.04 | 0.25 | 1.49 | 0.002 | 0.27 | — | 0.06 | — | — | 1.34 | — | — | 0.019 | 0.0077 | — | CC |
| | 7 | 0.07 | 0.13 | 1.21 | 0.005 | 0.16 | — | 0.04 | — | — | — | — | 0.003 | 0.016 | 0.0098 | — | CC |
| | 8 | 0.07 | 0.13 | 1.21 | 0.005 | 0.16 | — | 0.04 | — | — | — | — | 0.003 | 0.016 | 0.0098 | — | CC |
| | 9 | 0.06 | 0.20 | 1.65 | 0.003 | 0.20 | — | — | — | — | — | — | — | 0.012 | 0.0035 | — | CC |
| Comparison | 10 | 0.13 | 0.22 | 1.58 | 0.012 | 0.30 | — | 0.09 | — | 0.25 | 0.22 | — | — | 0.042 | 0.0081 | — | CC |
| | 11 | 0.06 | 0.32 | 1.55 | 0.003 | 0.45 | — | 0.07 | — | — | 0.98 | 0.009 | — | — | 0.0065 | 3 | IG |
| | 12 | 0.09 | 0.31 | 1.22 | 0.004 | 0.04 | 0.05 | 0.06 | — | — | 0.25 | — | — | 0.013 | 0.0071 | — | IG |

| Classification | Steels | Sheet Production Conditions: Heating Temp. (° C) | Heated γGrain Size (ASTM No.) | In the Temp. Range of 900–1050° C: Number of Passes | Reduction Percentage of Each Pass (in Time Sequence) (%) | Reduction Percentage at 900° C or lower (%) | Finishing Temp. (° C) | Rolled γGrain Size (ASTM No.) | Sheet Thickness (mm) |
|---|---|---|---|---|---|---|---|---|---|
| Present Invention | 1 | 1050 | 6.0 | 4 | 15.0, 15.0, 15.0, 15.0 | 70 | 470 | 8.5 | 16 |
| | 2 | 1150 | 3.0 | 3 | 15.0, 10.0, 20.0 | 75 | 730 | 7.5 | 12 |
| | 3 | 1150 | 3.0 | 6 | 10.0, 12.0, 12.5, 15.0, 15.0, 15.0 | 70 | 720 | 7.5 | 20 |
| | 4 | 1150 | 2.5 | 6 | 9.5, 8.0, 15.0, 10.0, 12.0, | 75 | 750 | 7.0 | 18 |
| | 5 | 1150 | 5.5 | 5 | 10.0, 15.0, 15.5, 20.0, 15.0 | 75 | 740 | 8.5 | 16 |
| | 6*2) | 1100 | 7.0 | 7 | 10.0, 15.0, 14.0, 15.0, 13.0, 12.0, 10.0 | 75 | 750 | 9.0 | 30 |
| | 7 | 1150 | 6.0 | 7 | 10.0, 12.5, 15.0, 14.0, 10.0, 15.0, 20.0 | 80 | 690 | 8.5 | 16 |
| | 8 | 1150 | 6.0 | 5 | 3.0, 6.0, 8.0, 8.0, 4.0 | 70 | 720 | 8.0 | 16 |
| | 9 | 980 | 7.0 | 5 | 4.0, 8.0, 10.0, 3.0, 8.0 | 65 | 720 | 8.5 | 26 |
| Comparison | 10 | 1150 | 3.5 | 4 | 10.0, 15.0, 13.0, 12.0 | 75 | 750 | 7.0 | 15 |
| | 11 | 1250 | −1.0 | 5 | 15.0, 12.0, 15.0, 10.0, 10.5 | 70 | 740 | 7.0 | 30 |
| | 12 | 1150 | 3.5 | 5 | 9.5, 8.0, 10.0, 20.0, 15.0 | 75 | 740 | 5.0 | 15 |

| Classification | Steels | Properties of Base Metal*3): Tensile Properties: Yield Point (kg/mm²) | Tensile Strength (kg/mm²) | Elongation (%) | 2mmV Charpy Impact Properties: vE-60° C (kg-m) | vTrs (° C) | DWTT 85% SATT (° C) |
|---|---|---|---|---|---|---|---|
| Present Invention | 1 | 48.0 | 56.3 | 40 | 12.3 | −112 | −60 |
| | 2 | 54.9 | 65.7 | 42 | 20.8 | −128 | −65 |
| | 3 | 50.3 | 62.9 | 44 | 20.3 | −115 | −60 |
| | 4 | 53.4 | 64.1 | 43 | 18.6 | −106 | −55 |
| | 5 | 47.1 | 54.4 | 41 | 16.2 | −129 | −70 |
| | 6 | 52.8 | 59.9 | 51 | 24.8 | −120 | −65 |
| | 7 | 52.8 | 64.4 | 42 | 15.9 | −123 | −75 |
| | 8 | 50.6 | 62.5 | 43 | 13.8 | −118 | −65 |
| | 9 | 48.7 | 57.1 | 44 | 21.6 | −135 | −75 |
| Comparison | 10 | 57.9 | 70.1 | 35 | 2.1 | −52 | +10 |
| | 11 | 51.3 | 64.2 | 47 | 11.2 | −80 | −25 |
| | 12 | 52.1 | 58.1 | 40 | 8.0 | −81 | −20 |

*1)CC: Continuous Casting Process; IG : Ingot-Making Process
*2)Subjected to heating at 530° C for 10 minutes to remove the hydrogen immediately after the rolling
*3)Properties of the base metal are expressed by values in the direction perpendicular to the final rolling direction.

What is claimed is:

1. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, and not more than 0.015% S, with the balance being iron and unavoidable impurities, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

2. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, 0.02–0.2% V, and not more than 0.015% S, with the balance being iron and unavoidable impurities, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

3. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, not more than 0.015% S, and at least one member selected from the group consisting of 0.001–0.03% REM, 0.0005–0.03% Ca and 0.004–0.03% Ti, with the balance being iron and unavoidable impurities, with the proviso that when the steel slab contains Ti, the steel slab also contains 0.001–0.009% N, and when the steel slab contains REM, the REM/S ratio is in the range of 1.0–6.0, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

4. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, 0.02–0.2% V, not more than 0.015% S, and at least one member selected from the group consisting of 0.001–0.03% REM, 0.0005–0.03% Ca and 0.004–0.03% Ti, with the balance being iron and unavoidable impurities, with the proviso that when the steel slab contains Ti, the steel slab also contains 0.001–0.009% N, and when the steel slab contains REM, the REM/S ratio is in the range of 1.0–6.0, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

5. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, not more than 0.015% S, and at least one member selected from the group consisting of not more than 0.6% Cr, not more than 0.6% Cu and not more than 2.5% Ni, with the balance being iron and unavoidable impurities, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

6. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, 0.02–0.2% V, not more than 0.015% S, and at least one member selected from the group consisting of not more than 0.6% Cr, not more than 0.6% Cu and not more than 2.5% Ni, with the balance being iron and unavoidable impurities, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

7. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, not more than 0.015% S, at least one member selected from the group consisting of 0.001–0.03% REM, 0.0005–0.03% Ca and 0.004–0.03% Ti, and at least one member selected from the group consisting of not more than 0.6% Cr, not more than 0.6% Cu and not more than 2.5% Ni, with the balance being iron and unavoidable impurities, with the proviso that when the steel slab contains Ti, the steel slab also contains 0.001–0.009% N, and when the steel slab contains REM, the REM/S ratio is in the range of 1.0–6.0, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

8. A method for producing a steel sheet having excellent low-temperature toughness, which comprises heating, to a temperature not higher than 1150° C., a steel slab containing 0.01–0.13% C, 0.05–0.8% Si, 0.8–1.8% Mn, 0.01–0.08% total Al, 0.08–0.40% Mo, 0.02–0.2% V, not more than 0.015% S, at least one member selected from the group consisting of 0.001–0.03% REM, 0.0005–0.03% Ca and 0.004–0.03% Ti, and at least one member selected from the group consisting of not more than 0.6% Cr, not more than 0.6% Cu and not more than 2.5% Ni, with the balance being iron and unavoidable impurities, with the proviso that when the steel slab contains Ti, the steel slab also contains 0.001–0.009% N, and when the steel slab contains REM, the REM/S ratio is in the range of 1.0–6.0, and hot rolling the steel slab thus obtained by (1) at least three rolling passes, with a minimum reduction of not less than 2% by each rolling pass, in a temperature range of 900°–1050° C., (2) a total reduction at 900° C. or lower of not less than 50%, and (3) a finishing temperature not higher than 820° C.

9. A method according to claim 1, wherein the reduction is more than 5% by each rolling pass in the temperature range of 900°–1050° C.

10. A method according to claim 2, wherein the reduction is more than 5% by each rolling pass in the temperature range of 900°–1050° C.

11. A method according to claim 3, wherein the reduction is more than 5% by each rolling pass in the temperature range of 900°–1050° C.

12. A method according to claim 4, wherein the reduction is more than 5% by each rolling pass in the temperature range of 900°–1050° C.

13. A method according to claim 5, wherein the reduction is more than 5% by each rolling pass in the temperature range of 900°–1050° C.

14. A method according to claim 6, wherein the reduction is more than 5% by each rolling pass in the temperature range of 900°–1050° C.

15. A method according to claim 7, wherein the reduction is more than 5% by each rolling pass in the temperature range of 900°–1050° C.

16. A method according to claim 8, wherein the reduction is more than 5% by each rolling pass in the temperature range of 900°–1050° C.

* * * * *